US008830058B2

(12) United States Patent
Yeh

(10) Patent No.: US 8,830,058 B2
(45) Date of Patent: Sep. 9, 2014

(54) DUET POWER-DRIVEN WINDOW SHADE

(71) Applicant: Bintronic Enterprise Co., Ltd., Kaohsiung County (TW)

(72) Inventor: Wei-Cheng Yeh, Kaohsiung County (TW)

(73) Assignee: Bintronic Enterprise Co., Ltd., Kaohsiung County (TW)

( * ) Notice: Subject to any disclaimer, the term of this patent is extended or adjusted under 35 U.S.C. 154(b) by 17 days.

(21) Appl. No.: 13/859,056

(22) Filed: Apr. 9, 2013

(65) Prior Publication Data

US 2014/0000816 A1 Jan. 2, 2014

(30) Foreign Application Priority Data

Jun. 28, 2012 (TW) ..... 101212499 U

(51) Int. Cl.
*G08B 21/00* (2006.01)
*A47H 5/032* (2006.01)
*E06B 9/74* (2006.01)

(52) U.S. Cl.
CPC ..... *A47H 5/0325* (2013.01); *E06B 9/74* (2013.01)
USPC ..... 340/540; 160/310

(58) Field of Classification Search
CPC ..... E06B 9/68; E06B 9/70; E06B 9/74
USPC ..... 340/540; 160/310
See application file for complete search history.

(56) References Cited

U.S. PATENT DOCUMENTS

| | | | | |
|---|---|---|---|---|
| 5,467,266 | A * | 11/1995 | Jacobs et al. | 160/1 |
| 5,848,634 | A * | 12/1998 | Will et al. | 160/310 |
| 6,680,594 | B2 * | 1/2004 | Collett et al. | 160/310 |
| 2012/0261079 | A1 * | 10/2012 | Chambers et al. | 160/6 |
| 2013/0233496 | A1 * | 9/2013 | Ogden et al. | 160/84.02 |
| 2014/0000818 | A1 * | 1/2014 | Anderson et al. | 160/310 |

* cited by examiner

*Primary Examiner* — John A Tweel, Jr.
(74) *Attorney, Agent, or Firm* — Rosenberg, Klein & Lee

(57) ABSTRACT

A duet power-driven window shade comprises a controlling device to receive an external controlling signal, which is then analyzed, determined and compared with a preset value in a memory unit of the controlling device. A driving signal is output via a processing unit according to a comparing result. A power source then brings convolutions of a first covering sheet and a second covering sheet in sequence or concurrently for increasing the rolling speed and the using convenience and allowing the connecting members connected to the covering sheets to be efficiently rolled up without entanglement so that the duet power-driven window shade is smoothly operated.

4 Claims, 6 Drawing Sheets

DUET POWER-DRIVEN WINDOW SHADE

BACKGROUND OF THE INVENTION

1. Field of the Invention

The present invention relates to a window shade, particular to a duet power-driven window shade.

2. Description of the Related Art

Referring to FIGS. 1 and 2, a conventional shade 1 of a TW patent publication No. M414904 includes a first covering sheet 11, a second covering sheet 12 connected to a bottom end of the first covering sheet 11, and a controlling device 13. Wherein the controlling device 13 includes a remote control 131 emitting an external controlling signal, at least one receiver 132 receiving the controlling signal, a logistic processing unit 133 electrically connected to the receiver 132, a first controlling module 134 electrically connected to the logistic processing unit 133, and a second controlling module 135 electrically connected to the logistic processing unit 133. The receiver 132 includes a first receiver 1321 and a second receiver 1322. The first controlling module 134 has a first positioning member 1340, a first motor 1341 electrically connected to the first positioning member 1340, at least one first roller 1342 driven by the first motor 1341, and at least one first rope 1343 disposed on the first roller 1342 and connected to the first covering sheet 11. The second module 135 has a second positioning member 1350, a second motor 1351 electrically connected to the second positioning member 1350, at least one second roller 1352 driven by the second motor 1351, and at least one second rope 1353 disposed to the second roller 1352 and connected to the second covering sheet 12.

Referring to FIGS. 1 and 2, in order to descend or roll up the first covering sheet 11, a first up button A, a first down button B, and a stop button C of the remote control 131 can be timely pressed to create respective controlling signals adapted to the first covering sheet 11. The first receiver 1321 thence receives and transmits the controlling signal to the logistic processing unit 133. The logistic processing unit 133 determines the controlling signal and forwards it to the first positioning member 1340 so that the first positioning member 1340 is able to control a rotating direction and a revolution number of the first motor 1341. The same operating mode for controlling the second covering sheet 12 is also described. Press a second up button A', a second down button B', and a second stop button C' of the remote control 131 to create respective controlling signals adapted to the second covering sheet 12. The second receiver 1322 receives and transmits the controlling signal to the logistic processing unit 133. The logistic processing unit 133 determines the controlling signal and forwards it to the second positioning member 1350 so that the second positioning member 1350 is able to control a rotating direction and a revolution number of the second motor 1351. The first controlling module 134 and the second controlling module 135 are respectively connected to the first covering sheet 11 and the second covering sheet 12, so the user uses the remote control 131 to descend or convolute the covering sheets 11, 12, separately.

The convention shade 1 may descend or roll up the covering sheets 11, 12, whereas, in view of the second covering sheet 12 connected to the bottom end of the first covering sheet 11 and the isolated controlling mode of the remote control 131, the shade has to arrange two separate receivers 1321, 1322 to receive different controlling signals for actions. Therefore, there may be problems while rolling the covering sheets 11, 12 up completely, described as follows:

1. To control the rolling movement of the second covering sheet 12 before controlling the rolling movement of the first covering sheet 11, the rolling movement of the first covering sheet 11 does not act until the second covering sheet 12 completes its rolling action by pressing the button and the user further presses the button to activate the first covering sheet 11, which however consumes time and incurs inconvenience. Further, the first covering sheet 11 is subjected to the propelling motion of the second covering sheet 12 from downward to upward during the rolling action, with the result that the first rope 1343 gets loose when the first roller 1342 is not prepared to be rotated. In this manner, when the first covering sheet 11 is ready to be rolled up, the loose first rope 1343 may be entangled and cannot be convoluted smoothly. Thus, the disorderly first rope 1343 causes a malfunction and easily affects the following rolling and descending operations.

2. To control the rolling movement of the first covering sheet 11 up before controlling the rolling movement of the second covering sheet 12, the rolling movement of the first covering sheet 11 propels the second covering sheet 12 upward and causes the second rope 1353 of the second covering sheet 12 to become loose. Further, some impatient users may conduct a rolling movement of the second covering sheet 12 directly, while the first covering sheet 11 has not been completed rolled up. In view of the second covering sheet 12 subjected to the rolling movement of the first covering sheet 11, the second rope 1353 gets loose more easily and becomes failed to be convoluted round the second roller 1352 entirely. Thus, the disorderly second rope 1353 causes a malfunction and affects the following operation.

3. Since the remote control 131 is operated by controlling the covering sheets 11, 12 respectively, the user cannot press to activate the two controlling signals at the same time. This design causes the rolling movements of the first covering sheet 11 and the second covering sheet 12 unable to be operated concurrently and the separate first receiver 1321 and the second receiver 1322 unable to perform the concurrent receiving actions, which causes a time differential. As a result, the rotating speeds of the first roller 1342 and the second roller 1352 can not be identical owing to the time differential. Adversely, the ropes 1343, 1353 get loose easily, both of which also cannot be entirely convoluted round the rollers 1342, 1352 while completing the rolling movement of the covering sheets 11, 12. In the next time of rolling or descending actions, the disorderly ropes 1343, 1353 may malfunction and decrease the operating effect.

SUMMARY OF THE INVENTION

The object of the present invention is to provide a duet power-driven window shade controlled by a unitary controlling device for enhancing the rolling speed and the using convenience, preventing the entanglement, and increasing the operating efficiency.

The duet power-driven window shade in accordance with the present invention comprises a frame, a driving device disposed in the frame, a controlling device connected to the driving device, a first connecting member as well as a second connecting member activated by the driving device, a first covering sheet connected to the first connecting member, and a second covering sheet connected to the second connecting member. The controlling device includes a receiver for receiving an external controlling signal, and an integrating module connected to the receiver. The integrating module has a processing unit for analyzing and determining the controlling signal received by the receiver and a memory unit connected to the processing unit, with a preset value stored therein. The controlling signal processed by the processing unit is compared with the preset value in the memory unit. A driving signal is output by the processing unit according to a comparing result for activating the first covering sheet and the second covering sheet to be convoluted automatically. Accordingly, when the power source receives the driving signal, the two covering sheets are activated sequentially or concurrently, and the two connecting members are prevented from entanglement while rolling up or descending the covering sheets, which ensures that the connecting members efficiently drives the operation for the present invention to increase a product quality and attain a smooth operation.

Preferably, the controlling device includes an outputting unit connected to the integrating module. The outputting unit can be an alarm, a buzzer, or a speaker.

Preferably, an anti-reversing unit is added in the integrating module; the anti-reversing unit is connected to the processing unit to prevent the integrating module from an interference of overloading currents or other factors, which allows the power source to receive the driving signal correctly.

Preferably, the controlling device includes a switch for outputting the controlling signal to the receiver.

DETAILED DESCRIPTION OF THE PREFERRED EMBODIMENTS

Figure 1:
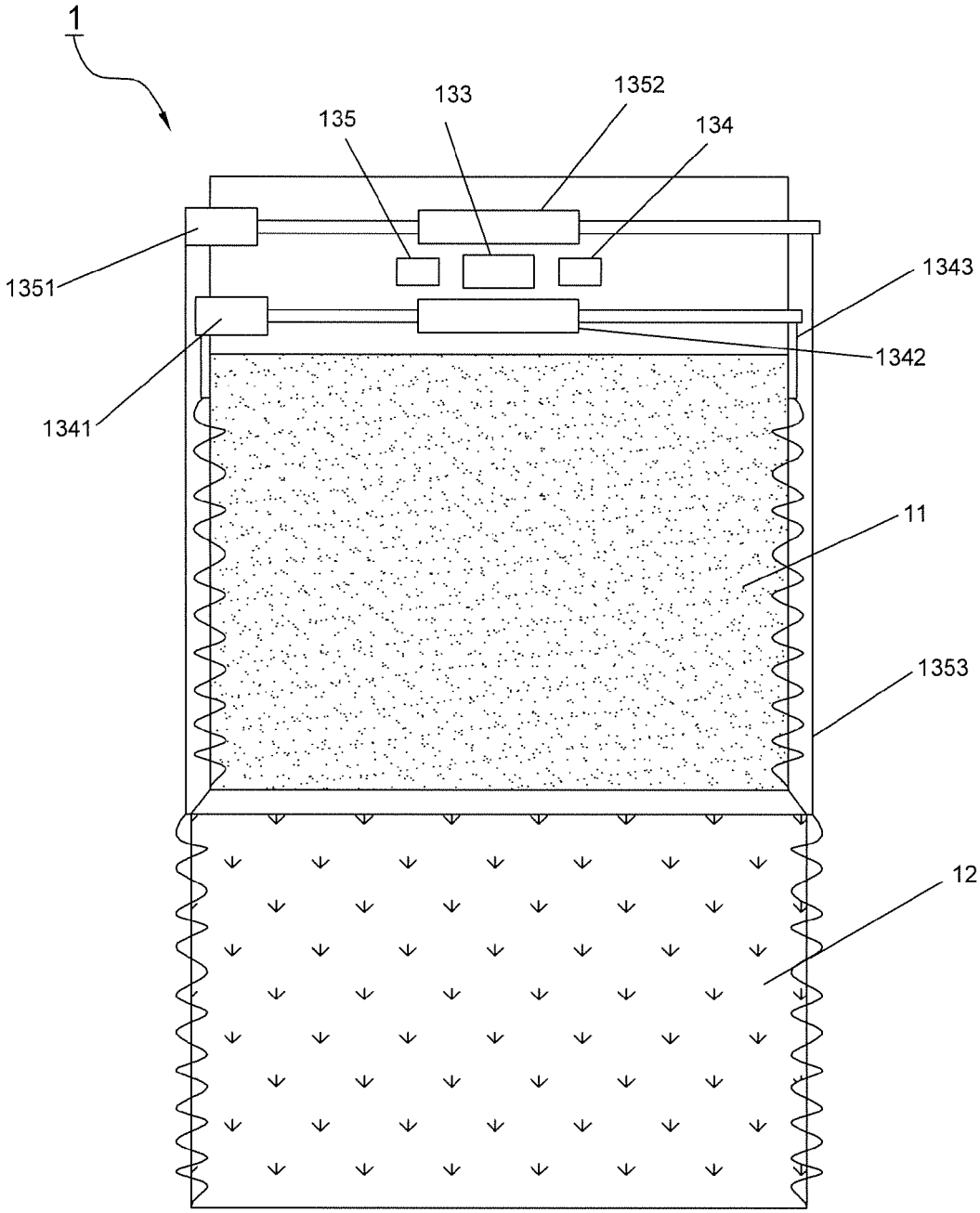
FIG. 1 is a schematic view showing a conventional invention.
Figure 2:
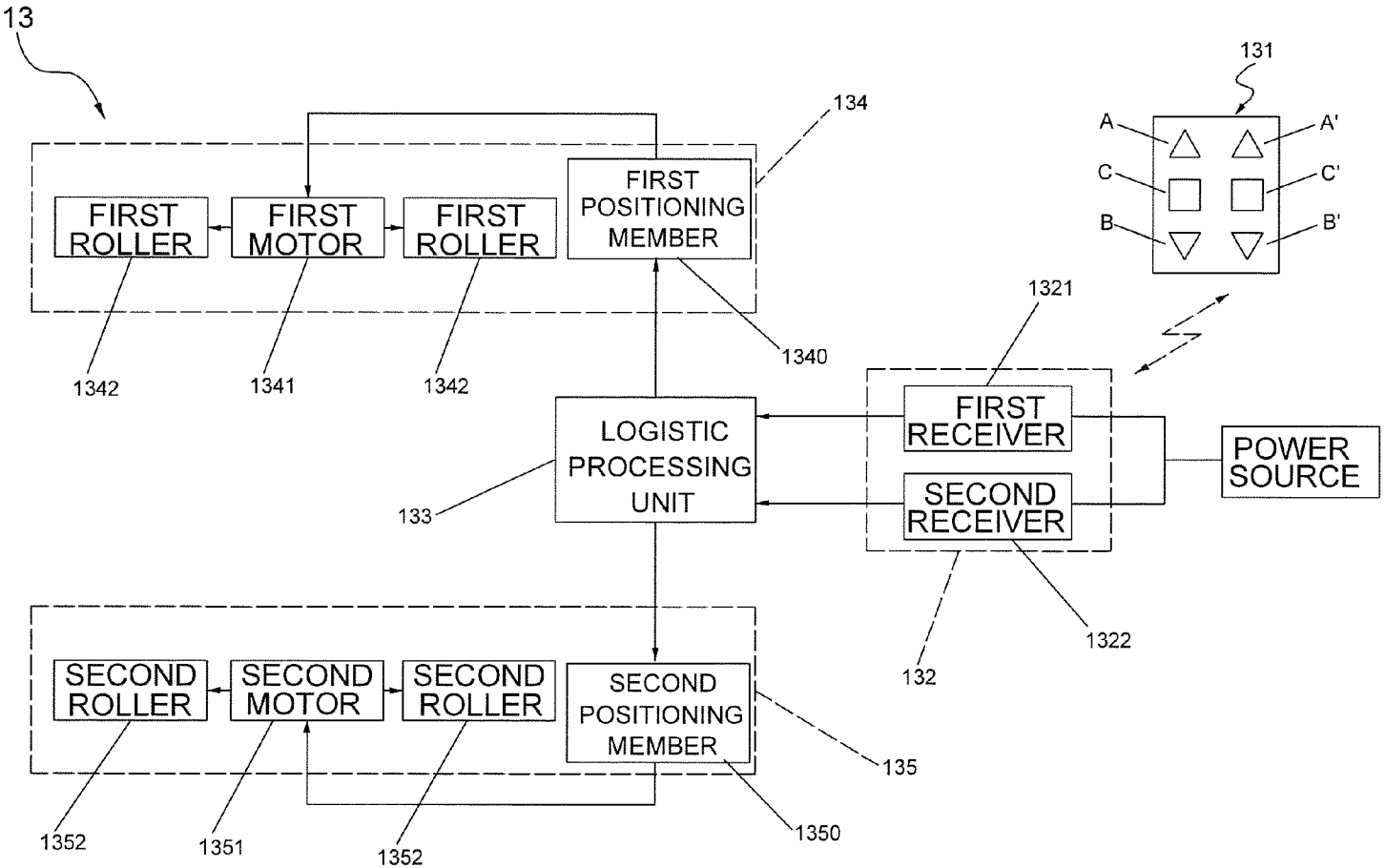
FIG. 2 is a block diagram showing the conventional invention.
Figure 3:
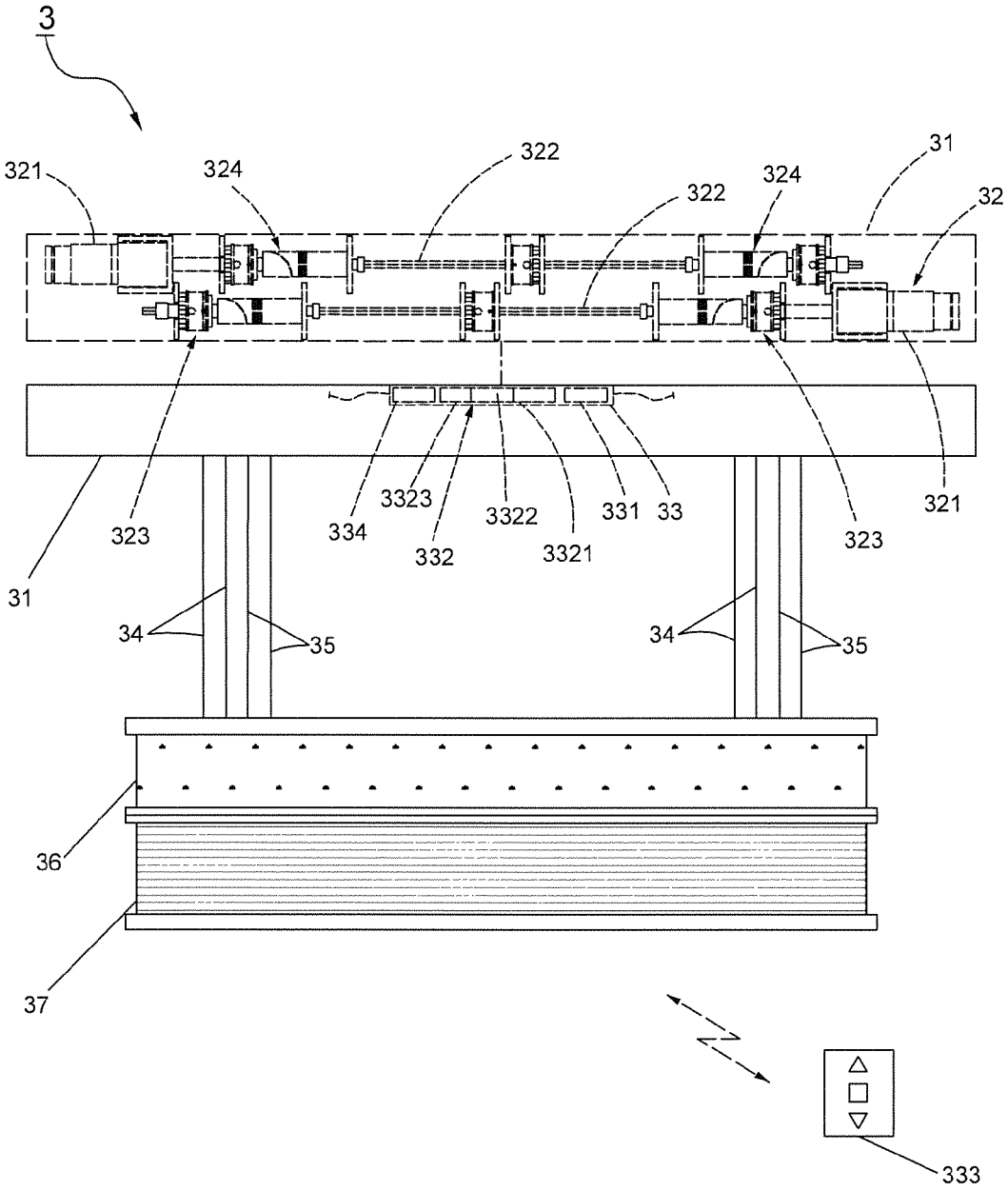
FIG. 3 is a schematic view showing a first preferred embodiment of the present invention.
Figure 4:
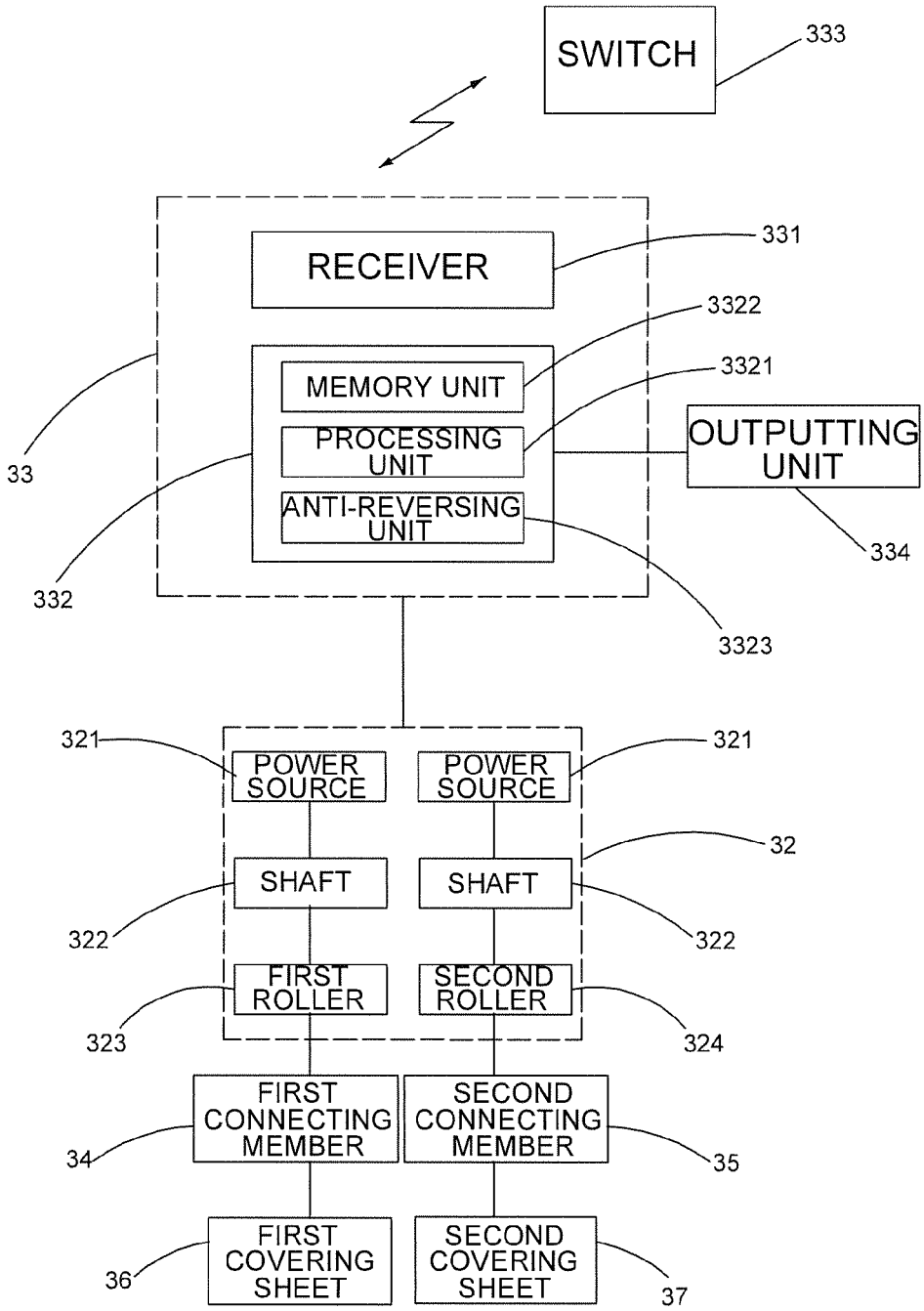
FIG. 4 is a block diagram showing the first embodiment.

FIGS. 3 and 4 show a first preferred embodiment of a duet power-driven window shade 3 of the present invention. The duet power-driven window shade 3 comprises a frame 31, a driving device 32 disposed in the frame 31, a controlling device 33 connected to the driving device 32, a first connecting member 34 as well as a second connecting member 35 activated by the driving device 32, a first covering sheet 36 connected to the first connecting member 34, and a second covering sheet 37 connected to the second connecting member 35. Wherein, the driving device 32 includes at least one power source 321, a shaft 322 triggered by the power source 321, a first roller 323 connected to the first connecting member 34 and driven by the power source 321, and a second roller 324 connected to the second connecting member 35 and driven by the power source 321. In this embodiment, two power sources 321 are adopted as illustrated. A bottom end of the first covering sheet 36 is connected to the second covering sheet 37. Preferably, the first covering sheet 36 can be the cloth pervious to light for the indoor space to be bathed in the nature light, and the second covering sheet 37 can be the cloth possessing a good shielding property to prevent the direct light efficiently.

Further, the controlling device 33 includes a receiver 331 for receiving an external controlling signal and an integrating module 332 connected to the receiver 331. The integrating module 332 includes a processing unit 3321 for analyzing and determining the controlling signal received by the receiver 331, a memory unit 3322 with a preset value stored therein connected to the processing unit 3321, and an anti-reversing unit 3323 preferably connected to the processing unit 3321. The controlling signal processed by the processing unit 3321 is compared with the preset value in the memory unit 3322 to attain a comparing result. A driving signal is output by the processing unit 3321 according to the comparing result to activate the power sources 321, which allows a concurrent rolling movement of the two covering sheets 36, 37 or allows the rolling movement of one covering sheet to succeed the complete rolling movement of the other covering sheet immediately. Regarding to the anti-reversing unit 3323, it keeps the integrating module 332 from an interference derived from overloading currents or other factors so that the power source 321 is able to receive the driving signal correctly. In this preferred embodiment, the controlling device 33 can further include a switch 333 for outputting a controlling signal to the receiver 331. The connection between the switch 333 and the controlling device 33 is wired or wireless, and the wireless mode is herein shown. In addition, the controlling device 33 has an outputting unit 334 connected to the integrating module 332. By using the switch 333 to transmit the external controlling signal to the controlling device 33, the driving device 32 is driven to start operation accordingly. Moreover, the outputting unit 334 can be an alarm, a buzzer, or a speaker to perform an operating status or an abnormality of the shade if necessary.

Figure 5:
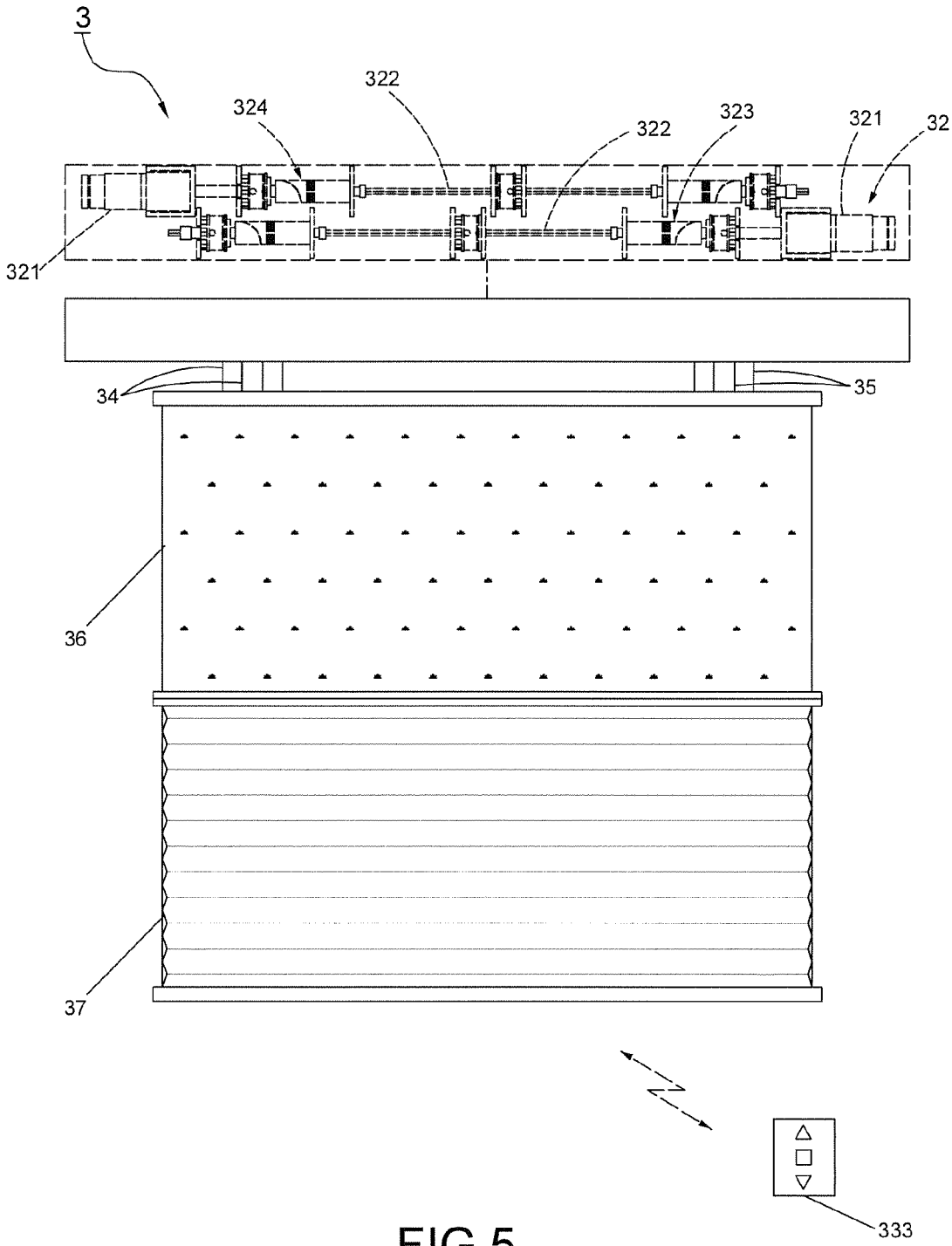
FIG. 5 is a first schematic view showing an operation of the first embodiment.

Referring to FIGS. 4 and 5, at a first time of installing the duet power-driven window shade 3, the connecting members 34, 35 are initially activated by the rollers 323, 324 to descend the covering sheets 36, 37 to their low limit positions or roll them up to their top limit positions. The value corresponding to these limit positions is stored in the memory unit 3322 and set as a preset value reference to the following convoluting and descending of the rollers 323, 324. Further, the interaction between the controlling device 33 and the switch 333 can be set properly. The initial installation of the duet power-driven window shade 3 is thence done. To start the descending operation of the covering sheets 36, 37, the switch 333 outputs a controlling signal corresponding to the release command and emits it to the receiver 331, and the receiver 331 transmits the controlling signal to the integrating module 332 so that the processing unit 3321 analyzes and determines the controlling signal. The signal is further compared with the preset value. Subsequently, a driving signal in light of the comparing result is emitted by the processing unit 3321 to activate the power source 321, and thence rotations of the shaft 322 and one roller, e.g. the second roller 324, are actuated to free the second connecting member 35 gradually for descending the corresponding covering sheet, e.g. the second covering sheet 37. When the second covering sheet 37 is fully spread, the first covering sheet 36 starts descending sequentially to its low limit position. Therefore, the descending of the covering sheets 36, 37 shelters the window completely and attains a window-closed effect.

Figure 6:
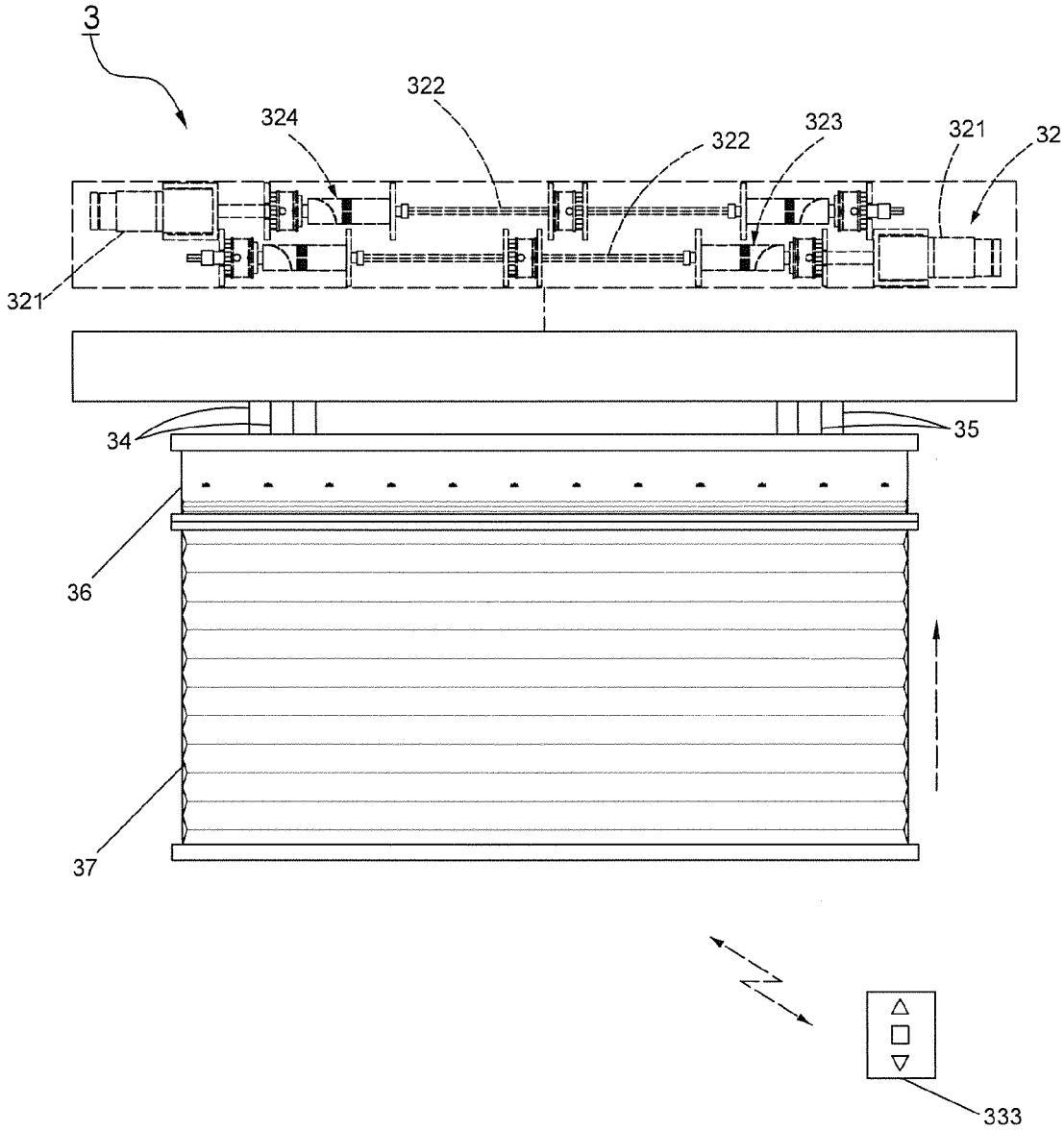
FIG. 6 is a second schematic view showing an operation of the first embodiment.

To start the convoluting operation of the covering sheets 36, 37, the switch 333 outputs a controlling signal corresponding to the rolling command and emits it to the receiver 331, and afterwards the signal is processed by the integrating module 332, namely the processing unit 3321 and the memory unit 3322. The processing unit 3321 generates a correspondent driving signal to the power source 321 to activate the rotation of one roller, e.g. the first roller 323, firstly and prepare the other roller, e.g. the second roller 324, to succeed the complete rotation of the former roller 323. During the operation, the first connecting member 34 is continuously convoluted round the first roller 323 until the first covering sheet 36 is completely rolled up, and then the second roller 324 sequentially starts convoluting the second connecting member 35 for rolling up the second covering sheet 37. Accordingly, the second covering sheet 37 can be rolled up, and the rolling operation is completed to attain a window-opened operating effect as shown in FIG. 6.

By presetting the connecting members 34, 35 to cooperate with the rollers 323, 324 when the duet power-driven window shade 3 is initially installed, the covering sheets 36, 37 can be rolled up in sequence or concurrently. For example, when a controlling signal commanding the first covering sheet 36 to roll is sent to the controlling device 33, the first connecting member 34 is convoluted round the first roller 323, and the second roller 324 is set ready to follow the first roller in sequence whereby the rollers 323, 324 work succeedingly without time differential and time consumption, and the connecting members 34, 35 are operated orderly without entanglement to increase the operating efficiency. Accordingly, the first covering sheet 36 and the second covering sheet 37 can be sequentially convoluted. The present controlling device 31 also allows the covering sheets 36, 37 to be rolled up concurrently. By dint of the unitary controlling device 31, the external controlling signal can be properly received, compared, analyzed, and processed promptly to emit the correct driving signal whereby the covering sheets 36, 37 are activated to descend or roll up precisely without interfering with each other, which is quite different from the conventional technique requiring separate receivers to receive different controlling signals and complicated components and installation. Further, the anti-reversing unit 3323 prevents the integrating module 332 from being interfered by overloading currents or other promiscuous factors, so that the power source 331 receives the driving signal correctly to allow a smooth operation and increase the using quality of the window shade.

From above, the present invention has following advantages directing to operation in different modes, namely rolling the first covering sheet 36 up first, rolling the second covering sheet 37 up first, and rolling both the covering sheets 36, 37 up concurrently:

1. If the second covering sheet 37 is to be firstly and the first covering sheet 36 is to be secondly rolled up, the unitary controlling device 33 is able to receive a single controlling signal to roll up the second covering sheet 37 completely. The first covering sheet 36 is driven to follow the former rolling movement in sequence. Therefore, the sequential motions of the covering sheets 36, 37 do not consume extra time since the first covering sheet 36 is not influenced by the second covering sheet 37. Preferably, the first connecting member 34 is thoroughly and efficiently convoluted round the first roller 323 without entanglement while the second covering sheet 37 is rolling up, which facilitates the using convenience.

2. If the first covering sheet 36 is to be firstly and the second covering sheet 37 is to be secondly rolled up, the second roller 324 is prepared to be rolled up during the rolling movement of the first covering sheet 36. After the first covering sheet 36 completes the rolling movement, the second roller 324 is driven to start its rotation immediately in order to render the second connecting member 35 able to be sequentially convoluted round the second roller 324. Without consuming extra time, the user simply outputs a controlling signal to sequentially activate both rolling movements of the covering sheets, which attain an efficient and smooth operation without wasting time.

3. If the covering sheets 36, 37 are to be rolled up concurrently, the unitary controlling device 33 allows a single controlling signal to activate the synchronic convolutions of the connecting members 34, 35 round the rollers 323, 324 and attain the effect of rolling the covering sheets 36, 37 at the same time. This synchronic operation prevents the time differential between the rolling movements of the covering sheets 36, 37 and allows the connecting members 34, 35 to be concurrently convoluted round the rollers 323, 324, thereby increasing operating smoothness.

To sum up, the present invention takes advantage of the controlling device to receive the single controlling signal which is further analyzed, determined, and compared by the integrating module. According to a comparing result, the controlling device triggers the power source to activate the covering sheets. The motions of the covering sheets do not influence mutually. The anti-reversing unit preferably keeps the integrating module from the interference of promiscuous factors to allow the power source to receive correct driving signal for operating precisely. Therefore, the arrangement of the unitary controlling device enhances the rolling speed and the using convenience without having respective receivers for receiving different controlling signals and allows the connecting members to be placed orderly without entanglement for increasing the operating smoothness.

Various modifications may be made in further embodiments described without departing from the spirit and scope of the invention.

I claim:

1. A duet power-driven window shade comprising a frame, a driving device disposed in said frame, a controlling device connected to said driving device, a first connecting member as well as a second connecting member activated by said driving device, a first covering sheet connected to said first connecting member, and a second covering sheet connected to said second connecting member; wherein said driving device includes at least one power source, at least one shaft triggered by said power source, a first roller connected to said first connecting member, and a second roller connected to said second connecting member; said first roller and said second roller being driven by said power source; a bottom end of said first covering sheet being connected to said second covering sheet;

wherein said controlling device includes a receiver for receiving an external controlling signal and an integrating module connected to said receiver; said integrating module including a processing unit for analyzing and determining said controlling signal received by said receiver and a memory unit connected to the processing unit, with a preset value stored therein; said controlling signal processed by said processing unit being compared with said preset value in said memory unit to attain a comparing result; said processing unit outputting a driving signal according to said comparing result for triggering said power source, which activates said first covering sheet and said second covering sheet to be convoluted automatically until said first and second covering sheets are rolled up completely.

2. The duet power-driven window shade as claimed in claim 1, wherein said controlling device includes an outputting unit connected to said integrating module; said outputting unit is an alarm, a buzzer, or a speaker.

3. The duet power-driven window shade as claimed in claim 1, wherein an anti-reversing unit is added in said integrating module; said anti-reversing unit is connected to said processing unit to prevent said integrating module from an interference derived from overloading currents or other factors, which allows said power source to receive said driving signal correctly.

4. The duet power-driven window shade as claimed in claim 1, wherein said controlling device includes a switch for outputting said controlling signal to said receiver.

* * * * *